US009814296B2

(12) United States Patent
Hong

(10) Patent No.: US 9,814,296 B2
(45) Date of Patent: Nov. 14, 2017

(54) METHOD FOR MOLDING SHAPE OF BRISTLES OF MASCARA BRUSH FOR EYELASHES, MOLD USED IN THE METHOD, AND MASCARA BRUSH MOLDED BY THE METHOD

(76) Inventor: Jeong Wook Hong, Gyeonggi-do (KR)

( * ) Notice: Subject to any disclaimer, the term of this patent is extended or adjusted under 35 U.S.C. 154(b) by 779 days.

(21) Appl. No.: 13/989,055

(22) PCT Filed: Jun. 28, 2011

(86) PCT No.: PCT/KR2011/004679
§ 371 (c)(1),
(2), (4) Date: May 22, 2013

(87) PCT Pub. No.: WO2012/081781
PCT Pub. Date: Jun. 21, 2012

(65) Prior Publication Data

US 2013/0232709 A1 Sep. 12, 2013

(30) Foreign Application Priority Data

Dec. 17, 2010 (KR) ..... 10-2010-0129933

(51) Int. Cl.

| | |
|---|---|
| ***A46D 9/00*** | (2006.01) |
| ***A45D 40/26*** | (2006.01) |
| ***A46B 3/18*** | (2006.01) |
| ***A46B 9/02*** | (2006.01) |
| ***A46B 9/06*** | (2006.01) |
| ***A46D 3/00*** | (2006.01) |
| ***A46D 9/02*** | (2006.01) |

(52) U.S. Cl.
CPC ..... *A45D 40/262* (2013.01); *A46B 3/18* (2013.01); *A46B 9/021* (2013.01); *A46B 9/06* (2013.01); *A46D 3/005* (2013.01); *A46D 9/00* (2013.01); *A46D 9/025* (2013.01); *A46B 2200/1053* (2013.01)

(58) Field of Classification Search
CPC .. A46D 3/00; A46D 3/005; A46B 3/00; A46B 3/005; A46B 3/18; B29D 1/00; B29C 43/02; B29C 53/02
USPC ..... 300/21; 264/243, 320, 324, 241, 296; 15/206; 425/127, 112, 395, 805
See application file for complete search history.

(56) References Cited

U.S. PATENT DOCUMENTS 5,321,919 A * 6/1994 Scheider ..... B24D 13/10 15/207.2
5,482,059 A * 1/1996 Miraglia ..... A45D 40/265 132/218

(Continued)

*Primary Examiner* — Todd E Manahan
*Assistant Examiner* — Brianne Kalach
(74) *Attorney, Agent, or Firm* — Sang Ho Lee; Novick, Kim & Lee, PLLC

(57) ABSTRACT

The present invention relates to a method for molding a shape of bristles of a mascara brush for eyelashes, a mold in used in the method. Two strands of iron cores are twisted and brush bristles respectively having dorsal portions are radially spread between the twisted iron cores through post-process so as to form a mascara brush, wherein the dorsal portions are formed by the brush bristles of the same length on the basis of the iron cores without difference in the length of the brush bristles, so that a mascara solution contained in the dorsal portion does not run down when being applied to eyelashes, and the mascara provides more volume and a beautiful eyelash make-up when a sufficient amount of the mascara solution is applied.

13 Claims, 5 Drawing Sheets

(56) References Cited

U.S. PATENT DOCUMENTS

| | | | | |
|---|---|---|---|---|
| 6,481,445 | B1 * | 11/2002 | Miraglia | A46B 3/18<br>132/218 |
| 2010/0071715 | A1 * | 3/2010 | Bickford | A46B 9/021<br>132/218 |

* cited by examiner

METHOD FOR MOLDING SHAPE OF BRISTLES OF MASCARA BRUSH FOR EYELASHES, MOLD USED IN THE METHOD, AND MASCARA BRUSH MOLDED BY THE METHOD

CROSS REFERENCE TO RELATED APPLICATIONS AND CLAIM OF PRIORITY

This patent application is a National Phase application under 35 U.S.C. §371 of International Application No. PCT/KR2011/004679, filed Jun. 28, 2011, which claims priority to Korean Patent Application No. 10-2010-0129933 filed Dec. 17, 2010, entire contents of which are incorporated herein by reference.

BACKGROUND

1. Technical Field

The present invention relates to a method for molding a shape of bristles of a mascara brush for eyelashes, a mold used in the method, and a mascara brush molded by the method. Two strands of iron cores are twisted and brush bristles respectively having dorsal portions are radially spread between the twisted iron cores through a post-process so as to form a mascara brush, wherein the dorsal portions are formed by the brush bristles of the same length on the basis of the iron cores without difference in the length of the brush bristles, so that a mascara solution contained in the dorsal portion does not run down when being applied to eyelashes, and the mascara provides more volume and a beautiful eyelash make-up by patterning out when a sufficient amount of the mascara solution is applied.

2. Description of the Related Art

Eyes have a great influence on a person's appearances and impressions. So, many women make a lot of efforts to make the optimum appearance and impression through eye makeup, and one of such efforts is eyelash makeup.

Eyelash makeup out of the eye makeup methods plays an important role to express eyes beautifully, and people use mascara brushes for eyelash makeup.

As mascara brushes used for eyelash makeup, there are rubber brushes and brushes having nylon bristles (brushes) spirally twisted between two strands of iron cores several times so as to have a circular section.

Because such mascara brushes have their own features and merits, users can select them according to the users' tastes and use purposes, but till now, mascara brushes manufactured using the nylon bristles are popular.

As described above, the mascara brush using the nylon bristles is manufactured by the steps of putting nylon bristles (brushes) between two strands of iron cores and spirally twisting them several times, and the manufactured mascara brush has a circular shape in horizontal section.

When the user applies eyelash makeup using the mascara brush, the user stains a mascara solution contained in a mascara container on the mascara brush and brushes the eyelashes with the mascara brush so that the mascara solution is applied to the eyelashes and the eyelashes are curled upwardly by the applied mascara.

As described above, the conventional mascara brush has several problems in that the mascara solution is not applied to the eyelashes uniformly and generates bubbles or is agglomerated because the mascara brush formed in a circular shape applies the mascara solution to the eyelashes in a state where the mascara solution is not smoothly permeated between the eyelashes.

In the case that the mascara solution generates bubbles or is agglomerated, the eyelashes are not curled upwardly and the applied mascara solution makes the eyelashes dirty, and hence, it may cause a feeling of aversion. In the case that the applied mascara solution is agglomerated, mascara applied to the eyelashes may drop from the eyelashes and get in eyes by wind, so that it may obstruct the user's field of vision or may cause skin troubles by dropping on the skin around the eyes.

In order to overcome the problems of the conventional mascara brush, mascara brushes of various shapes have been manufactured in such a way as to correspond with eyelashes.

In other words, the manufactured mascara brush has dorsal portions formed on the mascara brush through a post-process in such a manner that the dorsal portions first get in contact with the eyelashes when the user applies eyelash makeup using the mascara brush, and hence, the above-mentioned problem can be solved.

The dorsal portions are formed in such a way that the nylon bristle has a triangular shape or a serrated shape in horizontal cross section, and may be formed by various methods.

As described above, the mascara brush bristles made of nylon and having a circular shape are cut to have the dorsal portions of the triangular shape or the serrated shape.

Korean Utility Model Registration No. 20-0239112 discloses a "Mascara brush for eyelash makeup" in which brush bristles are formed by cutting.

In Korean Utility Model Registration No. 20-0239112, the mascara brush can apply a mascara solution to eyelashes uniformly without agglomeration and curl up the eyelashes easily because the brush bristles smoothly move through the eyelashes. However, because the mascara brush of the circular shape is cut into various shapes through the post-process, the brush bristles located at a position where the dorsal portions are formed are deteriorated in density, and hence, the mascara solution stained on the dorsal portions are easily separated and run down even by a small shock, it is difficult to apply the mascara solution with volume due to the lower density of the brush bristles at end portions of the dorsal portions, and it is also difficult to brush eyelashes evenly because the brush bristles of the dorsal portions are bent when the user brushes the eyelashes to which the mascara solution with viscosity is applied.

SUMMARY

Accordingly, the present invention has been made in an effort to solve the above-mentioned problems occurring in the prior arts, and it is an object of the present invention to provide a mascara brush for eyelash makeup, a mold for molding the mascara brush, and a method for molding a shape of bristles of a mascara brush for eyelashes, which includes the steps of: putting brush bristles in a dorsal portion molding hole of a mold for molding dorsal portions, which are radially on the basis of iron cores and enables a user to easily contact the brush to eyelashes when the user applies eyelash makeup; heating the mold in a molding furnace at heating temperature of 200° C. for 20 minutes so that the brush bristles made of nylon are formed in a shape corresponding to the dorsal portion molding hole of the mold; drawing out the mold from the molding furnace and extracting the brush bristles from the dorsal portion molding hole; holding the brush bristles on a drying rack and annealing them at room temperature to thereby form the dorsal portions formed radially, thereby preventing the mascara brush being bent when the user brushes eyelashes because the brush bristles having the dorsal portions have excellent rebound elasticity at their ends since the dorsal portions are not formed by cutting the brush bristles but the entire brush bristles have the same length uniformly to ends of the dorsal portions on the basis of the iron cores, storing a mascara solution between the brush bristles in safety and preventing the mascara solution from dropping down even though a shock is applied to the mascara during eyelash makeup so as to prevent the mascara solution from being stained on clothes because the brush bristles having the dorsal portions have the same length and the dorsal portions have higher density, applying the mascara solution with volume and providing a thick and beautiful eyelash makeup because the mascara brush is filled with the mascara solution of a sufficient amount between the brush bristles, and allowing a clean, neat, curved and beautiful eyelash makeup because the mascara brush has not only the dorsal portions with higher density of brush bristles but also dorsal portions with lower density of brush bristles enabling the user to evenly spread the mascara solution applied to the eyelashes by the dorsal portions with higher density.

To achieve the above objects, the present invention provides a method of molding a shape of mascara brush bristles for eyelash makeup including: a mascara preparing process of putting nylon bristles constituting brush bristles on two strands of iron cores and twisting them spirally several times so as to spread in all directions on the basis of the iron cores so that the brush bristles have a circular section; a mascara seating process of seating the brush bristles of the prepared mascara in a dorsal portion molding hole of a mold; a dorsal portion molding process of putting the mold, in which the brush bristles are seated, into a molding furnace and heating the molding furnace so that the brush bristles of the mascara made of nylon are thermally transformed into a form corresponding to the dorsal portion molding hole of the mold to thereby mold dorsal portions; a mascara extracting process of drawing out the mold and extracting the mascara brush having the dorsal portions by being thermally transformed in correspondence with the dorsal portion molding hole after the mold is heated and the brush bristles having the dorsal portions 21 are completely molded; and a plastic forming process of holding the mascara extracted from the dorsal portion molding hole of the mold on a drying rack so as to plastic-form the dorsal portions of the brush bristles formed by thermal transformation through an annealing process at room temperature.

To achieve the above objects, the present invention provides a mold used for molding a shape of mascara brush bristles for eyelash makeup including: a dorsal portion molding hole enabling the dorsal portions of the brush bristles of the mascara, which are formed by nylon bristles put on two strands of iron cores and twisted spirally several times so as to spread in all directions on the basis of the iron cores so that the brush bristles have a circular section, to be formed outwardly on the basis of the iron cores.

To achieve the above objects, the present invention provides a mascara brush for eyelash makeup including: two strands of iron cores; and brush bristles having dorsal portions, which are formed by nylon bristles put on the iron cores and twisted spirally several times so as to be formed radially on the basis of the iron cores, the brush bristles having the dorsal portions having the same length on the basis of the iron cores.

As described above, the mascara brush for eyelash makeup, the mold for molding the mascara brush, and the method for molding a shape of bristles of a mascara brush for eyelashes according to the present invention enable the user to easily contact the brush to eyelashes when the user applies eyelash makeup. The method for molding a shape of bristles of a mascara brush for eyelashes according to the present invention includes the steps of: putting brush bristles in a dorsal portion molding hole of a mold for molding dorsal portions, which are radially on the basis of iron cores; heating the mold in a molding furnace at heating temperature of 200° C. for 20 minutes so that the brush bristles made of nylon are formed in a shape corresponding to the dorsal portion molding hole of the mold; drawing out the mold from the molding furnace and extracting the brush bristles from the dorsal portion molding hole; holding the brush bristles on a drying rack and annealing them at room temperature to thereby form the dorsal portions formed radially, and the present invention provides the following effects.

First, the mascara brush according to the present invention can prevent the mascara brush being bent when the user brushes eyelashes because the brush bristles having the dorsal portions have excellent rebound elasticity at their ends since the dorsal portions are not formed by cutting the brush bristles but the entire brush bristles have the same length uniformly to ends of the dorsal portions on the basis of the iron cores.

Second, the mascara brush according to the present invention can store a mascara solution between the brush bristles in safety and preventing the mascara solution from dropping down even though a shock is applied to the mascara during eyelash makeup so as to prevent the mascara solution from being stained on clothes because the brush bristles having the dorsal portions have the same length and the dorsal portions have higher density.

Third, the mascara brush according to the present invention can apply the mascara solution with volume and providing a thick and beautiful eyelash makeup because the mascara brush is filled with the mascara solution of a sufficient amount between the brush bristles.

Fourth the mascara brush according to the present invention can enable the user to apply a clean, neat, curved and beautiful eyelash makeup because the mascara brush has not only the dorsal portions with higher density of brush bristles but also dorsal portions with lower density of brush bristles enabling the user to evenly spread the mascara solution applied to the eyelashes by the dorsal portions with higher density.

DETAILED DESCRIPTION

Figure 1:
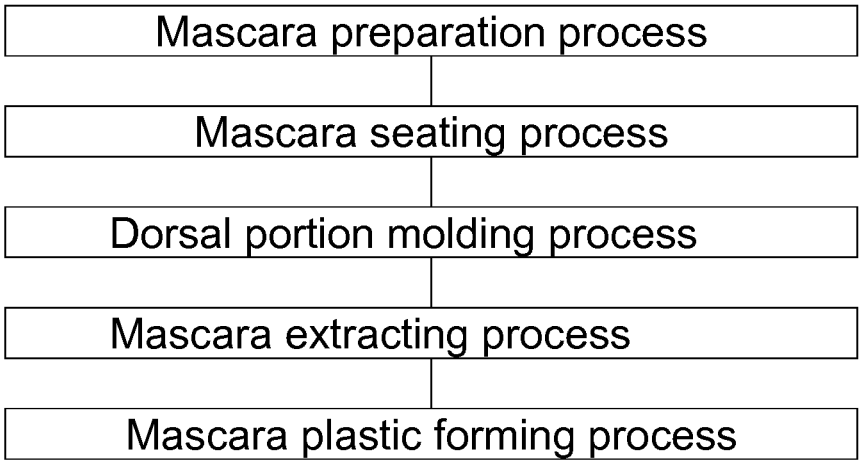
FIG. 1 is a flow chart of a method of molding a shape of mascara brush bristles for eyelash makeup according to the present invention.

A method of molding a shape of mascara brush bristles for eyelash makeup according to the present invention in order to achieve the above objects includes:

a mascara preparing process of putting nylon bristles constituting brush bristles 20 on two strands of iron cores 10, twisting them spirally several times so as to spread in all directions on the basis of the iron cores 10 so that the brush bristles 20 have a circular section;

a mascara seating process of seating the brush bristles 20 of the prepared mascara 1 in a dorsal portion molding hole 110 of a mold 100;

a dorsal portion molding process of putting the mold 100, in which the brush bristles 20 are seated, into a molding furnace with heat of 195° C. to 205° C. and heating the molding furnace for 17 minutes to 23 minutes so that the brush bristles 20 of the mascara 1 made of nylon are thermally transformed into a form corresponding to the dorsal portion molding hole 110 of the mold 100 to thereby mold dorsal portions 21;

a mascara extracting process of drawing out the mold 100 and extracting the mascara brush having the dorsal portions 21 by being thermally transformed in correspondence with the dorsal portion molding hole 110 after the mold 100 is heated and the brush bristles 20 having the dorsal portions 21 are completely molded; and a plastic forming process of holding the mascara extracted from the dorsal portion molding hole 110 of the mold 100 on a drying rack so as to plastic-form the dorsal portions 21 of the brush bristles 20 formed by thermal transformation through an annealing process at room temperature.

It is preferable that heating temperature of the molding furnace is 200° C. and a heating period of the mold 100 is 20 minutes.

The mold 100 used for molding the shape of the brush bristles of the mascara 1 includes the dorsal portion molding hole 110 enabling the dorsal portions 21 of the brush bristles 20 of the mascara 1, which are formed by nylon bristles put on two strands of iron cores and twisted spirally several times so as to spread in all directions on the basis of the iron cores 10 so that the brush bristles 20 have a circular section, to be formed outwardly on the basis of the iron cores 10.

As described above, the mold 100 having the dorsal portion molding hole 110 has different structures according to shapes and density of the dorsal portions 21.

In the case that the dorsal portions 21 are formed in a cross shape, the mold 100 includes a lower mold 120 and an upper mold 130. The lower mold 120 includes: molding apertures 121 having a width corresponding to a diameter of the circular brush bristles 20 and respectively having arranging dorsal portion molding slots 122, each of which is formed in the floor surface thereof and has a depth corresponding to a radius of the brush bristles 20 and a narrow width; and guide posts 123 formed at upper faces of both sides thereof for guiding the upper mold 130. The upper mold 130 includes: guide holes 133 formed at both sides thereof to which the guide posts 123 of the lower mold 120 are inserted; protrusions 131 corresponding to the molding apertures 121 of the lower mold 120; arranging dorsal portion molding slots 132 formed at the center corresponding to the arranging dorsal portion molding slots 122 of the molding apertures 121; and bolt holes 134 formed corresponding to bolt holes 124 of the lower mold 120 for inserting assembly bolts 135 thereinto. The dorsal portion molding hole 110 is formed in the cross shape when the lower mold 120 and the upper mold 130 are assembled together, and thereby, the brush bristles 20 are molded in such a way as to have the dorsal portions 21 respectively having the applying dorsal portions 21*a* with higher density and the arranging dorsal portions 21*b*.

Arranging dorsal portions 21*b* with lower density of the brush bristles are formed by the arranging dorsal portion molding slots 122 and 132 of the lower mold 120 and the upper mold 130, and applying dorsal portions 21*a* with higher density of the brush bristles are formed between the lower mold 120 and the upper mold 130.

The mold 100 may include a radial dorsal portion molding hole 110 according to another preferred embodiment of the present invention. In this embodiment, the mold 100 includes: an insertion hole 111 formed at the center thereof in such a manner that iron cores 10 are inserted thereinto; radial molding grooves 112 formed on the basis of the insertion hole 111 for molding the dorsal portions 21 radially; and end portions 113 of the radial molding grooves 112, each having a length corresponding to a radius of the circular brush bristles 20 on the basis of the insertion hole 111 in which the iron cores 10 are inserted.

The mold 100 having the radial dorsal portion molding hole 110 includes inclined surfaces 114, which gradually lower toward the radial molding grooves 112 and are continuously repeated in a concavo-convex form, such that the brush bristles 20 can be easily inserted into the radial molding grooves 112.

In the case of the brush bristles of the mascara manufactured by the above molding method, the nylon bristles constituting the brush bristles 20 are put on the two strands of the iron cores 10 and twisted spirally several times, so that the dorsal portions 21 of the nylon bristles are formed radially on the basis of the iron cores 10, and the brush bristles 20 having the dorsal portions 21 have the same length on the basis of the iron cores 10.

The dorsal portions 21 may include the applying dorsal portions 21*a* with higher density of the brush bristles 20 and the arranging dorsal portions 21*b* with lower density of the brush bristles 20, and alternatively, may have uniform density.

Figure 2:
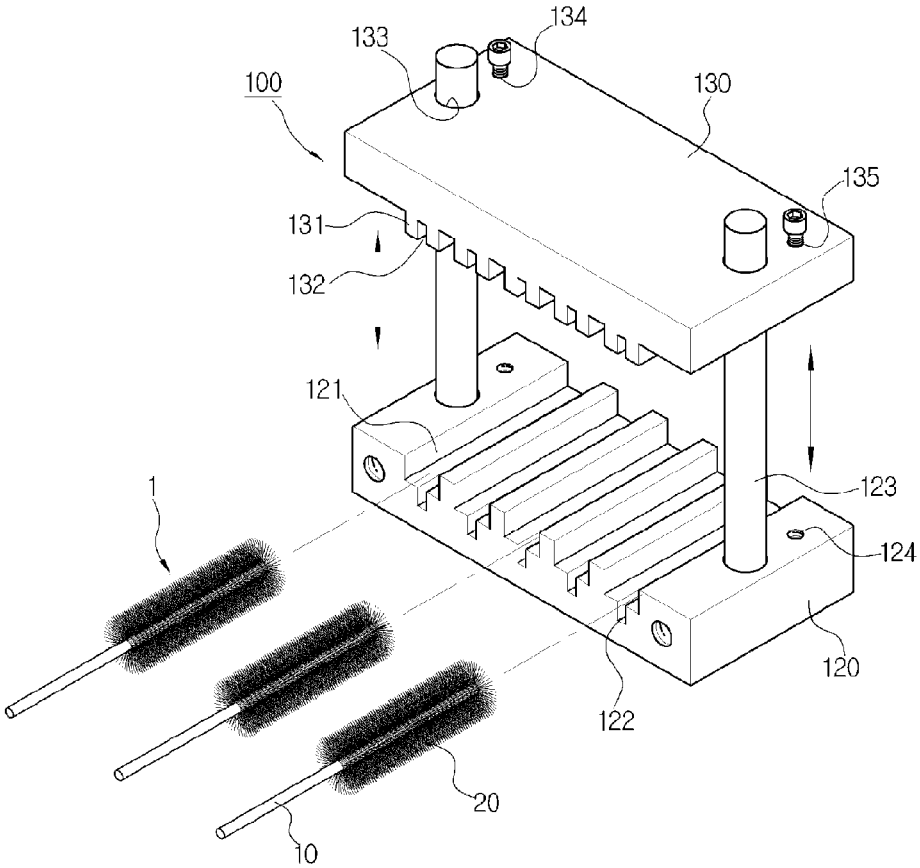
FIG. 2 is a view of a mold used in the method of molding a shape of mascara brush bristles for eyelash makeup according to a preferred embodiment of the present invention.
Figure 3:
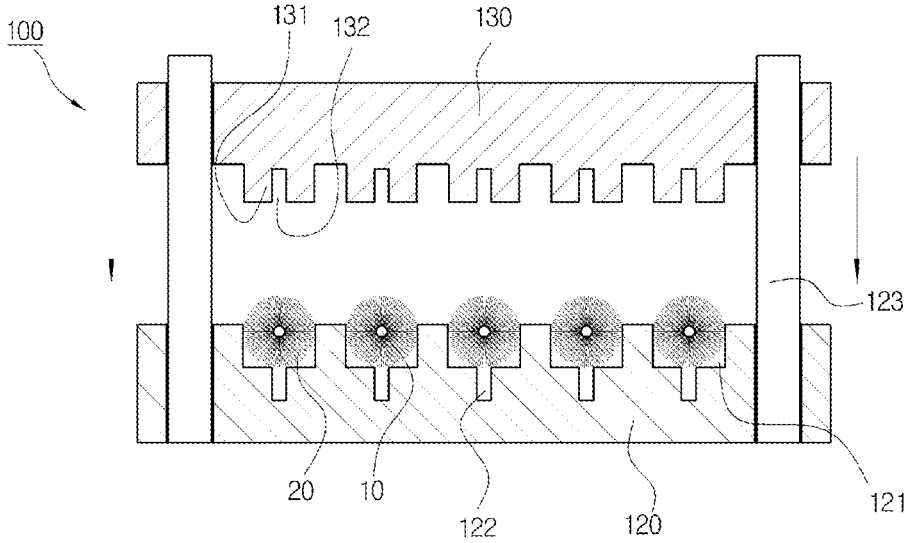
FIG. 3 is a front view of FIG. 2.

When the brush bristles 20 having the applying dorsal portions 21*a* and the arranging dorsal portions 21*b*, as shown in FIGS. 2 and 3, in a state where the upper mold 130 is separated from the lower mold 120, the brush bristles 20 of the mascara 1 are located in the molding hole 121 of the lower mold 120 as shown in FIG. 3.

In the state where the brush bristles 20 of the mascara 1 are located in the molding hole 121 of the lower mold 120, the upper mold 130 is joined to the lower mold 120.

Figure 4:
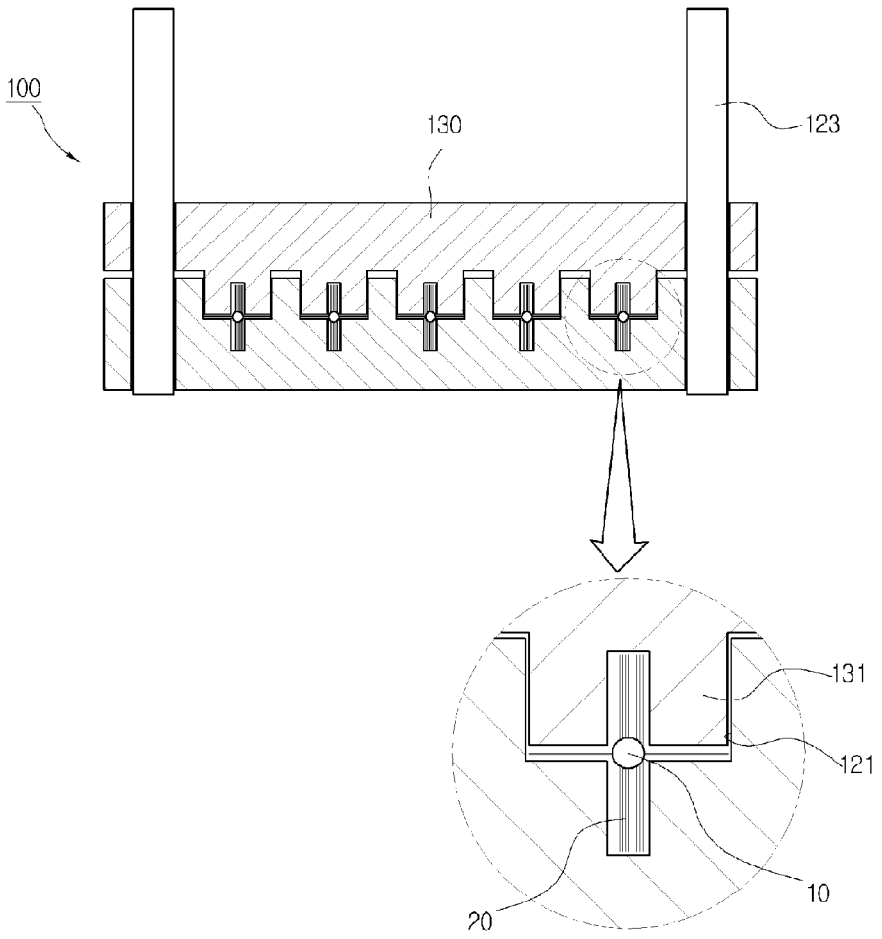
FIG. 4 is a view showing a state where mascara brush bristles are seated in a dorsal portion molding hole of the mold of FIG. 2.

As described above, when the upper mold 130 is joined to the lower mold 120, the protrusions 131 are inserted into the molding apertures 121 of the lower mold 120, and hence, the brush bristles 20 having the dorsal portions 21 are formed, and in this instance, the applying dorsal portions 21*a*, which has higher density and good rebound elasticity and allow the user to easily apply a mascara solution to eyelashes, are in a temporarily molded state, and at the same time, the arranging dorsal portions 21*b* are also in a temporarily molded state in the arranging dorsal portion molding slots 122 and 132 respectively formed in the lower mold 120 and the upper mold 130 (See FIG. 4).

As described above, when the upper mold 130 and the lower mold 120 are joined together, the assembly bolts 135 are fastened to the bolt holes 124 of the lower mold 120 so as to keep the joined state.

Figure 7:
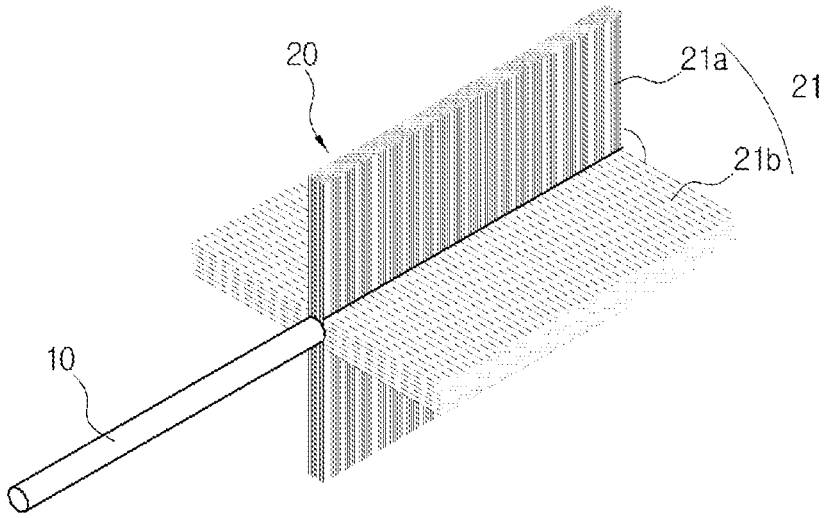
FIG. 7 is a view showing a state where dorsal portions are formed on the brush bristles by the mold of FIG. 2.

In the above state, the mold 100 is inserted into a molding furnace, heated at heating temperature of 195° C. to 205° C. for 17 minutes to 23 minutes, and then, drawn out from the molding furnace. The mascara 1 is extracted from the mold 100 drawn out from the molding furnace, and then, annealed at room temperature, so that the brush bristles 20 having the dorsal portions 21, which have the applying dorsal portions 21*a* and the arranging dorsal portions 21*b*, are manufactured as shown in FIG. 7.

In order to extract the brush bristles 20 having the dorsal portions 21, which have the applying dorsal portions 21*a* and the arranging dorsal portions 21*b*, the assembly bolts 135 are released, and then, the upper mold 130 is separated from the lower mold 120.

Figure 5:
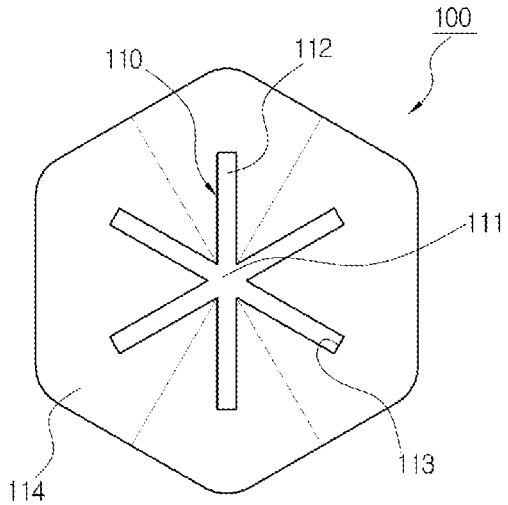
FIG. 5 is a view of a mold used in the method of molding a shape of mascara brush bristles for eyelash makeup according to another preferred embodiment of the present invention.
Figure 6:
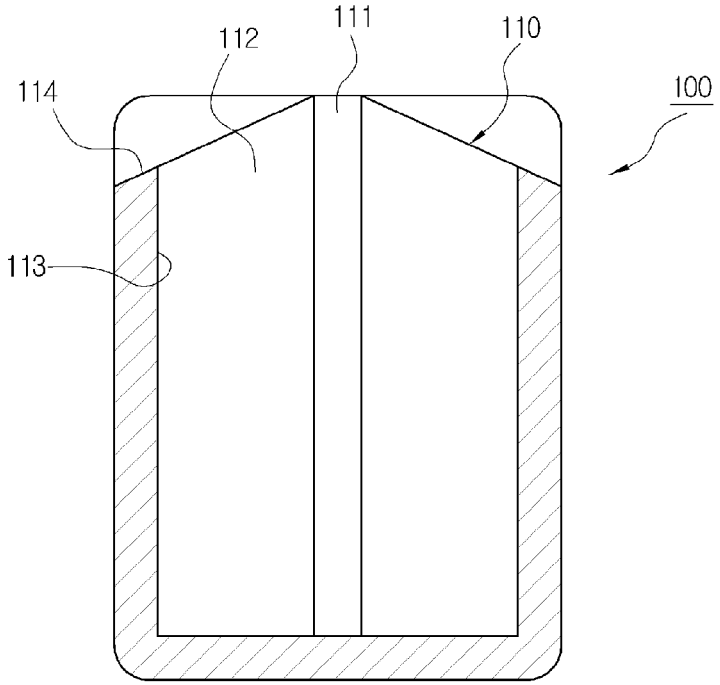
FIG. 6 is a plan view of FIG. 5.

FIGS. 5 and 6 illustrate a mold according to another preferred embodiment of the present invention. In this embodiment, the dorsal portions 21 are radially formed on the basis of the iron cores 10, and when the brush bristles 20 are pushed into the radial molding grooves 112 of the dorsal portion molding hole 110 in a state where the iron cores 10 coincide with the insertion hole 111 of the center, the brush bristles 20 are guided to the inclined surfaces 114 so that the brush bristles 20 are inserted into the molding hole 110 neatly.

The inclined surfaces 114 have a form that ridges and valleys are continuously repeated because a portion where the dorsal portion molding hole 110 is located is lower and a point where the dorsal portion molding holes 110 are equally divided is higher.

Figure 8:
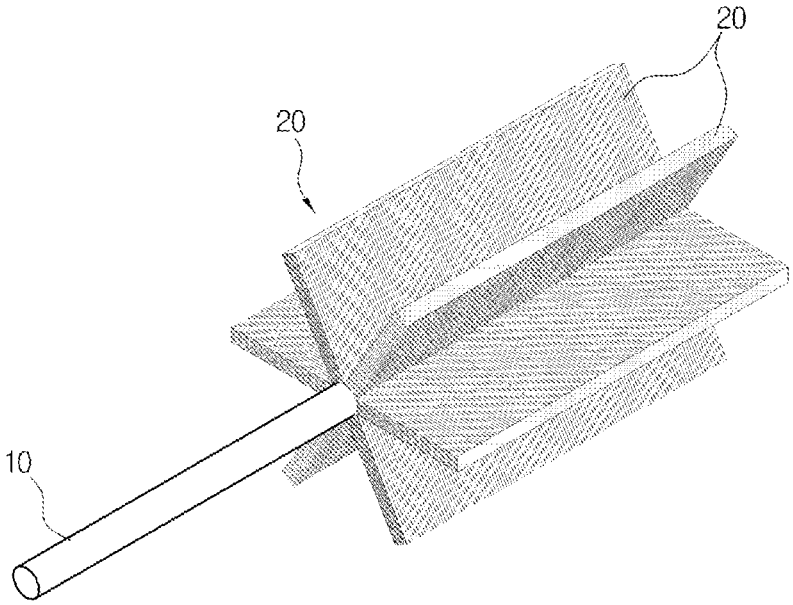
FIG. 8 is a view showing a state where dorsal portions are formed on the brush bristles by the mold of FIG. 5.

The mold 100, in which the brush bristles 20 are inserted into the dorsal portion molding hole 110 in such a way that the dorsal portions 21 are temporarily molded, is inserted into a molding furnace with heating temperature of 195° C. to 205° C., heated for 17 minutes to 23 minutes, and then, drawn out from the molding furnace. The mascara 1 is extracted from the mold 100 drawn out from the molding furnace, and then, annealed at room temperature, so that the brush bristles 20 having the dorsal portions 21 are manufactured as shown in FIG. 8.

The dorsal portions 21 of the brush bristles 20 may be formed in a straight form or in a three-way form.

The invention claimed is:

1. A method of molding a shape of mascara brush bristles for eyelash makeup, the method comprising:

preparing a mascara brush having brush bristles and iron core, the brush bristles extended in radial directions from the iron core, wherein the iron core is extended in a longitudinal direction;

seating the brush bristles between a first mold and a second mold, wherein the first mold has at least one first molding slot and a first press portion, and the second mold has at least one second molding slot and a second press portion, and wherein each of the at least one first molding slot, the first press portion, the at least one second molding slot, and the second press portion is extended in the longitudinal direction;

compressing the brush bristles by the first mold and the second mold, and forming a high-density brush bristle and a lower-density brush bristle, wherein each of the high-density brush bristle and the lower-density brush bristle is extended in the longitudinal direction, wherein the high-density brush bristle is formed by a compression molding by the first press portion and the second press portion, the lower-density brush bristle is formed by the at least one first molding slot and the at least one second molding slot, and the high-density brush bristle has a higher density than the lower-density brush bristle; wherein the step of forming the high-density brush bristle and the lower-density brush bristle comprises heating the first mold and the second mold; and drying the mascara brush having the high-density brush bristle and the lower-density brush bristle.

2. The method according to claim 1, wherein the step of heating is performed in a range of 195° C. to 205° C.

3. The method according to claim 1, wherein the step of heating is performed for 17 minutes to 23 minutes.

4. The method of claim 1, wherein the at least one first molding slot and the at least one second molding slot are extended in opposite vertical direction, and the first press portion and the second press portion are extended in opposite horizontal direction.

5. The method of claim 1, wherein the at least one first molding slot and the first press portion are extended in different direction, and wherein the at least one second molding slot and the second press portion are extended in different direction.

6. The method of claim 1, wherein the high-density brush bristle is extended in a first direction, and the lower-density brush bristle is extended in a second direction, wherein the first direction and the second direction are different.

7. The method of claim 5, wherein the first direction is normal to the second direction.

8. The method of claim 1, wherein the high-density brush bristle and the hower-density brush bristle are extended in a cross shape.

9. The method of claim 1, wherein each of the high-density brush bristle and the lower-density brush bristle is extended in the longitudinal direction with a predetermined thickness.

10. The method of claim 1, wherein the at least one first molding slot, the first press portion, the at least one second molding slot, and the second press portion are in a cross shape.

11. The method of claim 1, wherein the at least one first molding slot, the first press portion, the at least one second molding slot, and the second press portion are extended in a radial direction.

12. The method of claim 1, wherein the at least one first molding slot and the at least one second molding slot are extended in opposite vertical direction, and the first press portion and the second press portion are extended in opposite horizontal direction.

13. A method of molding a shape of mascara brush bristles for eyelash makeup, the method comprising:

preparing a mascara brush having brush bristles and iron core, the brush bristles extended in radial directions from the iron core, wherein the iron core is extended in a longitudinal direction;

seating the brush bristles between a first mold and a second mold, wherein the first mold has at least one first molding slot and a first press portion, and the second mold has at least one second molding slot and a second press portion, and wherein each of the at least one first molding slot, the first press portion, the at least one second molding slot, and the second press portion is extended in the longitudinal direction;

compressing the brush bristles by the first mold and the second mold, and forming a high-density brush bristle and a lower-density brush bristle, wherein each of the high-density brush bristle and the lower-density brush bristle is extended in the longitudinal direction; and drying the mascara brush having the high-density brush bristle and the lower-density brush bristle.

* * * * *